US012280412B2

(12) United States Patent
Otsuka et al.

(10) Patent No.: US 12,280,412 B2
(45) Date of Patent: Apr. 22, 2025

(54) COIL SKID AND STEEL SHEET MANUFACTURING METHOD

(71) Applicant: NIPPON STEEL CORPORATION, Tokyo (JP)

(72) Inventors: Takayuki Otsuka, Tokyo (JP); Tooru Akashi, Tokyo (JP); Kazuki Shiokawa, Tokyo (JP); Yuki Takeuchi, Tokyo (JP); Hiroki Matsubara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 461 days.

(21) Appl. No.: 17/763,877

(22) PCT Filed: Oct. 2, 2020

(86) PCT No.: PCT/JP2020/037540
§ 371 (c)(1),
(2) Date: Mar. 25, 2022

(87) PCT Pub. No.: WO2021/066141
PCT Pub. Date: Apr. 8, 2021

(65) Prior Publication Data

US 2022/0347732 A1 Nov. 3, 2022

(30) Foreign Application Priority Data

Oct. 4, 2019 (JP) ..... 2019-183532

(51) Int. Cl.
*B21C 47/28* (2006.01)
*B21B 1/22* (2006.01)
(Continued)

(52) U.S. Cl.
CPC ..... *B21C 47/28* (2013.01); *B21B 45/02* (2013.01); *B21C 47/24* (2013.01); *B21B 2001/221* (2013.01); *B65H 49/16* (2013.01)

(58) Field of Classification Search
CPC ..... B21C 47/28; B21C 47/24; B21B 45/02; B21B 2001/221; B65H 49/16; C22C 38/04; C22C 38/00
See application file for complete search history.

(56) References Cited

FOREIGN PATENT DOCUMENTS

JP 56-45212 A 4/1981
JP S5645211 A * 4/1981 ..... B21C 47/06
(Continued)

OTHER PUBLICATIONS

JP-2004001019-A: Espacenet English machine translation (Year: 2004).*
JPS5645211A: Espacenet English machine translation (Year: 1981).*

*Primary Examiner* — Adil A. Siddiqui
(74) *Attorney, Agent, or Firm* — Birch, Stewart, Kolasch & Birch, LLP

(57) ABSTRACT

A coil skid on which a hot-rolled coil 1 obtained by coiling a hot-rolled steel sheet is placed includes: at least two or more layers of a metal plate 11 and at least two or more layers of a heat insulating material 12 each stacked alternately, in which the metal plate 11 is in contact with the hot-rolled coil 1. The uneven cooling of an outer peripheral portion of the hot-rolled coil caused by the coil skid is prevented while ensuring the strength of the coil skid, to thereby inhibit the uneven hardness in the longitudinal direction of the hot-rolled coil resulting from this uneven cooling.

5 Claims, 2 Drawing Sheets

(51) Int. Cl.

| | |
|---|---|
| ***B21B 45/02*** | (2006.01) |
| ***B21C 47/24*** | (2006.01) |
| ***B65H 49/16*** | (2006.01) |

(56) References Cited

FOREIGN PATENT DOCUMENTS

| | | | | |
|---|---|---|---|---|
| JP | 2004-1019 | A | | 1/2004 |
| JP | 2004001019 | A | * | 1/2004 |
| JP | 2005-186145 | A | | 7/2005 |
| JP | 2015-167992 | A | | 9/2015 |

* cited by examiner

COIL SKID AND STEEL SHEET MANUFACTURING METHOD

TECHNICAL FIELD

The present invention relates to a coil skid and a steel sheet manufacturing method that cools a hot-rolled coil on this coil skid.

BACKGROUND ART

In the case of high-strength steel sheets such as thin high-tensile steel sheets (ultra high-tensile strength steel such as TRIP steel in particular), a hot-rolled coil obtained by coiling a hot-rolled steel sheet by a coiler is drawn out from the coiler to be conveyed to a coil skid on a coil yard by a coil car and is cooled naturally. During this cooling on the coil car or coil yard, uneven cooling caused by the skid on which the hot-rolled coil is placed (hereinafter referred to as a "coil skid") occurs. The heat extraction from the skid in contact with an outer peripheral surface of the coil causes the cooling rate of the coil outer peripheral portion in contact with the skid to be faster than that of the other portions, and thereby this uneven cooling is caused, resulting in a higher hardness of the contact portion. As a result, the temperature unevenness (uneven hardness) occurs in the coil outer peripheral portion in the longitudinal direction of a cold-rolled original sheet (hot-rolled steel sheet). This uneven hardness has caused gauge hunting (thickness variation) in cold rolling to occur, and countermeasures have been urgently needed from the perspectives of equipment maintenance, operational stability, and quality.

As a technique to prevent the occurrence of such gauge hunting in cold rolling, for example, Patent Document 1 discloses the prevention of hardness variation in a hot-rolled coil by heating a portion of a coil car in contact with the hot-rolled coil and inhibiting a local martensitic transformation of an outer peripheral portion of the hot-rolled coil. Further, it is also described that the effect of preventing the hardness variation of the hot-rolled coil can be further enhanced by insulating a portion of a coil stand (coil skid) on a coil yard in contact with the hot-rolled coil, or the like.

Further, for example, Patent Document 2 discloses that in the case of using a coil box after coiling of a hot-rolled steel sheet, a hot-rolled coil is accommodated inside a holding container surrounded by a heat insulating material, a steel holding member, which holds the hot-rolled coil, is provided on the heat insulating material, and the mass of this holding member is set to 10% or less of the mass of the hot-rolled coil.

PRIOR ART DOCUMENT

Patent Document

Patent Document 1: Japanese Laid-open Patent Publication No. 2004-001019

Patent Document 2: Japanese Laid-open Patent Publication No. 2015-167992

DISCLOSURE OF THE INVENTION

Problems to be Solved by the Invention

However, the technique of Patent Document 1 above causes an increase in cost because the portion of the coil car in contact with the hot-rolled coil is heated. Further, in this case, the martensitic transformation can be inhibited, but it is desired to further reduce the subtle difference in cooling rate. In addition, as the method of insulating the portion of the coil skid in contact with the hot-rolled coil, it has been disclosed that a heat insulating material is laid between the coil skid and the hot-rolled coil, but in this case, the heat insulating material may adhere to the coil.

The technique of Patent Document 2 above causes a problem of deformation of the heat insulating material due to insufficient strength of the heat insulating material because there is only one layer of the heat insulating material under the steel holding member. In addition, as illustrated in FIG. 1 and FIG. 2 in Patent Document 2, in the case where an outer peripheral portion of the hot-rolled coil is in contact with the heat insulating material, the heat insulating material may adhere to the coil.

The present invention has been made in consideration of the above-described problems, and an object thereof is to prevent uneven cooling of an outer peripheral portion of a hot-rolled coil caused by a coil skid while ensuring the strength of the coil skid, to thereby inhibit uneven hardness in the longitudinal direction of the hot-rolled coil resulting from this uneven cooling.

Means for Solving the Problems

The present invention to solve the above-described problems is a coil skid on which a hot-rolled coil obtained by coiling a hot-rolled steel sheet is placed, the coil skid including: at least two or more layers of a metal plate and at least two or more layers of a heat insulating material each stacked alternately, in which the metal plate is in contact with the hot-rolled coil.

According to the present invention, it is possible to prevent the uneven cooling of the outer peripheral portion of the hot-rolled coil caused by the coil skid while ensuring the strength of the coil skid itself (and further a coil yard and/or coil car, coil box where the coil skid is provided). Therefore, it becomes possible to inhibit the uneven hardness in the longitudinal direction of the hot-rolled coil resulting from this uneven cooling, and further to inhibit the gauge hunting in cold rolling of the steel sheet caused by the uneven hardness when cold rolling is performed.

The total thickness of the heat insulating material may be 100 mm or more.

The thickness of each of the heat insulating materials may be 70 mm or less.

The present invention according to another aspect is a steel sheet manufacturing method including coiling a hot-rolled steel sheet into a coil, and then conveying the coiled hot-rolled coil to a coil yard by a coil car, and cooling the hot-rolled coil on either or both of the coil car and the coil yard, in which on either or both of the coil car and the coil yard, the above-described coil skid is provided.

On either or both of the coil car and the coil yard, a coil box intended for housing the hot-rolled coil therein may be provided, and in the coil box, the above-described coil skid may be provided.

According to the present invention, it is possible to prevent the uneven cooling of the outer peripheral portion of the hot-rolled coil caused by the coil skid while ensuring the strength of the coil skid itself (and further the coil yard and/or coil car, coil box where the coil skid is provided). Therefore, it becomes possible to inhibit the uneven hardness in the longitudinal direction of the hot-rolled coil resulting from this uneven cooling.

A coiling temperature of the hot-rolled steel sheet may be 400° C. to 750° C.

After cooling the hot-rolled coil, cold rolling may be performed. Incidentally, even in the case where cold rolling is performed, it becomes possible to inhibit the gauge hunting in cold rolling of the steel sheet caused by the uneven hardness.

Effect of the Invention

According to the present invention, the uneven cooling of the outer peripheral portion of the hot-rolled coil caused by the coil skid is prevented while ensuring the strength of the coil skid, thereby making it possible to inhibit the uneven hardness in the longitudinal direction of the hot-rolled coil resulting from this uneven cooling.

EMBODIMENTS FOR CARRYING OUT THE INVENTION

Figure 1:
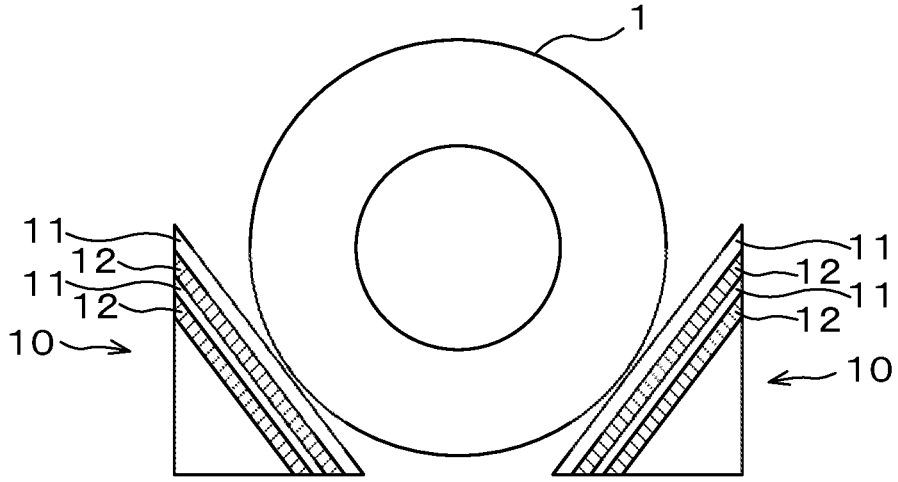
FIG. 1 is an explanatory view illustrating the outline of a configuration of a coil skid according to an embodiment of the present invention.

Hereinafter, an embodiment of the present invention will be explained with reference to the drawings. Incidentally, in this description and the drawings, components having substantially the same functional configuration are denoted by the same reference numerals and symbols, and thus repeated explanation of these is omitted.

In the embodiment of the present invention, based on the above-described problems, in order to inhibit the uneven hardness in the longitudinal direction of the hot-rolled coil, and further to inhibit the gauge hunting in cold rolling of the steel sheet caused by the aforementioned uneven hardness when cold rolling is performed, there is employed a coil skid in which at least two or more layers of a metal plate and at least two or more layers of a heat insulating material are each alternately stacked as a means to prevent the uneven cooling of the outer peripheral portion of the hot-rolled coil caused by the coil skid. Further, the aforementioned metal plate is in contact with the hot-rolled coil, that is, the surface of the coil skid on the side that is in contact with the hot-rolled coil is formed of the aforementioned metal plate. By employing such a coil skid, both the strength of the coil skid and the heat insulating effect on the hot-rolled coil can be achieved. Such a coil skid according to this embodiment will be described in detail below.

(Coil Skid)

FIG. 1 is an explanatory view illustrating the outline of a configuration of a coil skid 10 according to this embodiment. The coil skid 10 is provided to place a hot-rolled coil 1 thereon in a coil yard, a coil car, a coil box, or the like, for example.

As illustrated in FIG. 1, the coil skid 10 in this embodiment is a coil stand for placing thereon the hot-rolled coil 1 obtained by coiling a hot-rolled steel sheet by a coiler or the like, and has a structure in which at least two or more layers of a metal plate 11 and at least two or more layers of a heat insulating material 12 are each alternately stacked (namely, a staked structure of at least four layers). Here, in this embodiment, at least two or more layers of the metal plate 11 and at least two or more layers of the heat insulating material 12 are each alternately stacked, and this structure is required to achieve both the strength of the coil skid 10 and the heat insulating effect on the hot-rolled coil 1. On the other hand, even if the total thickness of the metal plate 11 and the total thickness of the heat insulating material 12 each are the same as that of the case where two or more layers are stacked, the strength of the coil skid 10 will be insufficient, causing a problem such as a dent of the metal plate 11, for example, in the case where one layer of the metal plate 11 and one layer of the heat insulating material 12 are only stacked.

As the metal plate 11, for example, an iron plate (steel plate), a stainless steel plate, a copper plate, a titanium plate, an aluminum plate, and so on (preferably an iron plate (steel plate) and a stainless steel plate) can be used. Further, as the heat insulating material 12, for example, inorganic materials such as glass wool, rock wool, and ceramic fiber, as well as composite plates of inorganic materials and resin, and so on (preferably an iron plate (steel plate) and a stainless steel plate) can be used, but the material is not limited in particular as long as it is a material that has a heat insulating effect capable of inhibiting the heat extraction of the coil skid 10 from the hot-rolled coil 1. Here, the heat insulating material means a material that has a function of a thermal conductivity of 0.3 W/m/K or less at 800° C. or less.

Further, in this embodiment, the metal plate 11 located on an outermost layer of the coil skid 10 (namely, the side in contact with the hot-rolled coil 1) is in contact with the hot-rolled coil 1. When the heat insulating material 12 is located at the outermost layer of the coil skid 10 to be in contact with the hot-rolled coil 1, the heat insulating material 12 may adhere to the outer peripheral portion of the hot-rolled coil 1, as described above. Further, since as the heat insulating material 12, for example, a material having a relatively low hardness such as glass wool is used, the strength will be insufficient to cause a problem such as a dent of the surface of the coil skid 10.

The coil skid 10 according to this embodiment described above can prevent the uneven cooling of the outer peripheral portion of the hot-rolled coil 1 caused by the coil skid 10 while ensuring the strength of the coil skid 10 itself (and further the coil yard and/or coil car, coil box where the coil skid 10 is provided). Therefore, it becomes possible to inhibit the uneven hardness in the longitudinal direction of the hot-rolled coil 1 resulting from this uneven cooling, and further to inhibit the gauge hunting in cold rolling of the steel sheet caused by the aforementioned uneven hardness when cold rolling is performed.

Here, the total thickness of the heat insulating material 12 is preferred to be 100 mm or more. In particular, in the case of a high-strength steel sheet (high-tensile steel sheet) where a coiling temperature of the hot-rolled steel sheet is 400° C. to 750° C. and a tensile strength (product strength) of the hot-rolled steel sheet is 700 MPa or more, the total thickness of the heat insulating material 12 is preferred to be 100 mm or more. The reason why the total thickness of the heat insulating material 12 is preferred to be 100 mm or more will be explained below with reference to FIG. 2. Incidentally, the total of the average thicknesses of two or more layers of the heat insulating material 12 is the total thickness of the heat insulating material 12. For example, the thickness of the heat insulating material 12 on the side close to the hot-rolled coil 1 illustrated in FIG. 1 means the distance between the surface of the metal plate 11 on the side close to the hot-rolled coil 1 and the surface of the metal plate 11 on the side far from the hot-rolled coil 1. Further, the average thickness means the arithmetic mean of the thicknesses at five randomly selected locations (however, the region where contact with the hot-rolled coil 1 is expected is set to a region to be measured).

Figure 2:
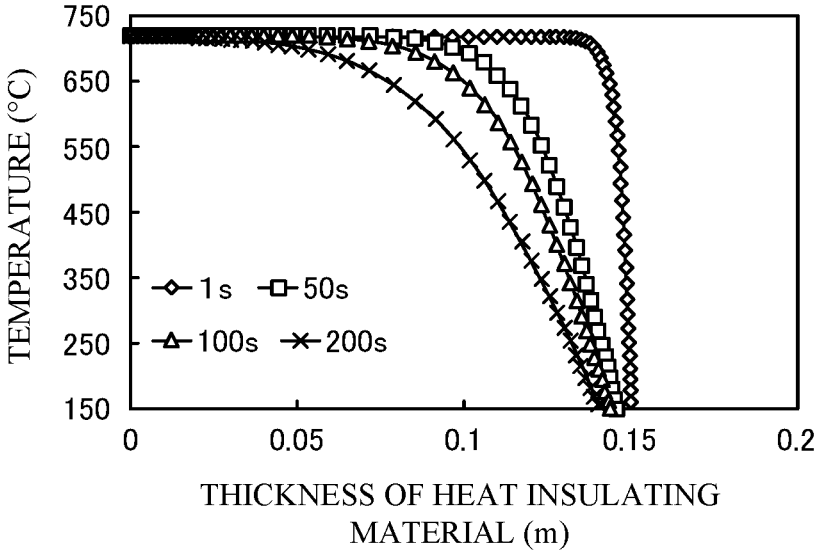
FIG. 2 is a graph illustrating one example of a temperature change in the thickness direction of a heat insulating material when a steel sheet at room temperature is brought into contact with an underside of the heat insulating material.

FIG. 2 is a graph illustrating one example of a temperature change in the thickness direction of the heat insulating material when the steel sheet at room temperature is brought into contact with the underside of the heat insulating material.

In order to examine a suitable range of the total thickness of the heat insulating material 12, first, as an example, a slab for 1.2 GPa-class cold-rolled steel sheet containing, as its component, in mass %, C: 0.2%, Si: 0.1%, Mn: 2.0%, P: 0.005%, and S: 0.001% was heated to 1200° C. in a heating furnace and rolled to a thickness of 2.5 mm by hot rolling. After hot rolling, a plurality of hot-rolled coils, each of which was obtained by coiling at 720° C. by using a coiler, were prepared.

Then, these hot-rolled coils were cooled to ordinary temperature on a coil yard with an ordinary iron coil skid and rolled to a thickness of 1.19 mm by cold rolling. The thickness distributions of the hot-rolled steel sheet and the cold-rolled steel sheet in the longitudinal direction were measured, and then it was found out that gauge hunting, which did not occur in hot rolling, occurred in cold rolling. It was confirmed that the cycle of the gauge hunting, which was able to be confirmed only in the thickness distribution of the cold-rolled steel sheet in the longitudinal direction, was equivalent to one roll of the hot-rolled coil. Uneven hardness is caused in the longitudinal direction of the hot-rolled coil by uneven cooling of the outer peripheral portion of the hot-rolled coil caused by the coil skid, and gauge hunting caused by the uneven hardness occurs in the cold-rolled steel sheet.

Here, when the relationship between a continuous cooling transformation (CCT) diagram of the above-described hot-rolled steel sheet and the temperature change of the steel sheet due to heat extraction from the iron coil skid is examined, it is found out that a transformation rate is about 90% when 200 seconds have passed after the hot-rolled steel sheet is coiled into the coil, and the transformation is almost complete. Here, the strength (hardness) of the hot-rolled steel sheet is affected by the structure formed depending on its cooling rate. Thus, the present inventors examined the structure of the coil skid that prevents the transformation from progressing too far when 200 seconds have passed after coiling.

In this embodiment, in order to avoid the effect of heat extraction by the coil skid from the portion in contact with the outer peripheral portion of the hot-rolled coil, a coil skid including a heat insulating material was used, and there was examined the thickness of the heat insulating material so that when 200 seconds passed after coiling of the hot-rolled steel sheet into the coil, the temperature of the outer peripheral portion of the hot-rolled coil would hardly change and the transformation structure would not be affected. For this examination, a temperature analysis of the heat insulating material itself was performed.

Specifically, a 0.15-in-thick glass wool, which was heated to 720° C., was used as the heat insulating material, and there was measured the temperature change in the thickness direction of this heat insulating material when the heat insulating material was cooled by bringing the steel sheet at room temperature into contact with the underside (surface 0.15 in down in the thickness direction from the top surface of the heat insulating material as a reference) of the heat insulating material. Results of the measurement are illustrated in FIG. 2. For example, the legend "1 s" in FIG. 2 indicates the temperature change in the thickness direction of the heat insulating material 1 second after the steel sheet is brought into contact with the heat insulating material. The same is true of the others.

As illustrated in FIG. 2, for example, after 1 second passed since the steel sheet was brought into contact with the heat insulating material, the temperature did not decrease in almost the entire thickness of the heat insulating material, indicating that the heat insulating material was hardly cooled. Further, after 200 seconds passed since the steel sheet was brought into contact with the heat insulating material, the temperature hardly decreased until 0.05 in of the thickness of the heat insulating material. As a result, it was found out that in the case of using the heat insulating material having a thermophysical property value equivalent to that of the glass wool, as long as the total thickness of the heat insulating material 12 included in the coil skid 10 was at least 100 mm (=0.15 in to 0.05 in), the outer peripheral portion of the hot-rolled coil 1 in contact with the coil skid 10 was hardly cooled (namely, the outer peripheral portion of the hot-rolled coil 1 was able to be insulated) and was not affected by the uneven cooling, and the transformation structure was also not affected. The fact that the transformation structure is also not affected (transformation does not progress easily) can be seen from the fact that the transformation rate is less than 50% if the steel sheet is hardly cooled even after 200 seconds after coiling, from the results of examination of the relationship between the CCT diagram of the hot-rolled steel sheet and the temperature change of the steel sheet due to heat extraction from the iron coil skid.

Based on the above examinations, in the coil skid 10 in this embodiment, the total thickness of the heat insulating material 12 is preferred to be 100 mm or more. The upper limit value of the total thickness of the heat insulating material 12 is not particularly limited, but may be 500 mm or less due to the balance between a heat insulating effect and a strength.

Further, the coil skid 10 has a stack in which at least two or more layers of the metal plate 11 and at least two or more layers of the heat insulating material 12 are each stacked alternately. The stacked structure is made, to thereby increase the strength of the coil skid 10 as compared to a structure including one layer of the metal plate 11 and one layer of the heat insulating material 12.

Incidentally, the thickness of each of the heat insulating materials 12 is preferred to be 70 mm or less. The fact that the thickness of each of the heat insulating materials 12 is 70 mm or less can further increase the strength of the coil skid 10. The lower limit value of the thickness of each of the heat insulating materials 12 is not limited in particular, but it may be 10 mm or more due to the balance between a heat insulating effect and a strength. Here, the thickness of each of the heat insulating materials 12 indicates the average thickness of two or more layers of the heat insulating material 12. The average thickness means the arithmetic mean of the thicknesses at five randomly selected locations (however, the region where contact with the hot-rolled coil 1 is expected is set to a region to be measured).

Incidentally, the total thickness of the metal plate 11 and the thickness of each metal plate 11 may be determined in consideration of the strength of the coil yard required from the mass of the hot-rolled coil 1. Further, in the case where the metal plate in contact with the surface of the hot-rolled coil is thick, the effect of cooling from the metal plate increases, and thus, the thickness of the metal plate in contact with the surface of the hot-rolled coil is desirably within 10 mm.

In this embodiment, the method of coiling the hot-rolled coil 1 is not particularly limited, but for example, the hot-rolled steel sheet may be coiled by a coiler. In other words, the coil skid 10 according to this embodiment may be used simultaneously with a coil box, that is, the coil skid 10 according to this embodiment may be provided in a coil box (heat insulation box) in which the hot-rolled coil 1 is housed and kept warm. By using the coil skid 10 according to this embodiment simultaneously with the coil box, the hot-rolled coil 1 is cooled while being kept warm by the coil box, thereby making it possible to further reduce the heat extraction through the coil skid 10. Incidentally, in the case where the coil skid 10 is used simultaneously with the coil box, the aforementioned coil skid 10 and the aforementioned coil box may be provided on either or both of the coil car and the coil yard.

Further, in this embodiment, the place where the coil skid 10 is provided is not limited in particular, but, for example, the coil skid 10 can be provided on the coil car that conveys the hot-rolled coil 1 to the coil yard after coiling, on the coil yard where the hot-rolled coil 1 is placed after hot rolling, or the like. Further, the coil skid 10 may be provided in a coil box (heat insulation box) intended for housing the hot-rolled coil 1 therein between a rough rolling step and a finishing rolling step of a hot rolling line, for example.

(Steel Sheet Manufacturing Method)

The configuration of the coil skid 10 according to this embodiment has been explained in detail above, and then, a steel sheet manufacturing method according to this embodiment that includes a step of cooling the hot-rolled coil 1 on this coil skid 10 is explained in detail.

In the steel sheet manufacturing method according to this embodiment, after the hot-rolled steel sheet is coiled into a coil, the coiled hot-rolled coil 1 is conveyed by a coil car to a coil yard, and the hot-rolled coil 1 is cooled on either or both of the coil car and the coil yard. In this embodiment, on either or both of the coil car and the coil yard, the coil skid 10 described above, namely, the coil skid 10 including at least two or more layers of the metal plate 11 and two or more layers of the heat insulating material 12 each stacked alternately is provided. Further, the metal plate 11 is in contact with the hot-rolled coil 1.

According to the steel sheet manufacturing method using the coil skid 10 according to this embodiment described above, it is possible to prevent the uneven cooling of the outer peripheral portion of the hot-rolled coil 1 caused by the coil skid 10 while ensuring the strength of the coil skid 10 itself (and further the coil yard or/and coil car where the coil skid 10 is provided). Accordingly, it becomes possible to inhibit the uneven hardness in the longitudinal direction of the hot-rolled coil 1 resulting from this uneven cooling. Further, in the case where this hot-rolled coil 1 is used and cold rolling is performed, and then a steel sheet is manufactured, it is possible to inhibit the gauge hunting in cold rolling of the steel sheet caused by the uneven hardness generated in the longitudinal direction of the hot-rolled coil 1.

In the steel sheet manufacturing method according to this embodiment, the hot-rolled coil 1 may be manufactured by setting, for example, the coiling temperature to 400° C. to 750° C. Then, after cooling the hot-rolled coil 1, cold rolling is performed, and thereby a steel sheet with a tensile strength of greater than 700 MPa may be manufactured. According to this embodiment, it is possible to achieve the steel sheet manufacturing method in which gauge hunting in cold rolling is inhibited.

EXAMPLE

Example 1

In order to confirm the effect of the steel sheet manufacturing method using the coil skid 10 according to the embodiment of the present invention described above, a slab for 1.2 GPa-class cold-rolled steel sheet containing, as its component, in mass %, C: 0.2%, Si: 0.1%, Mn: 2.0%, P: 0.005%, and S: 0.001% was heated to 1200° C. in a heating furnace and then was rolled to a thickness of 2.5 mm by hot rolling. After hot rolling, a plurality of hot-rolled coils, each of which was obtained by coiling at 720° C. by using a coiler, were prepared.

Further, as a result of examining the required strength of the coil yard from the mass of the hot-rolled coil, it was found out that the strength was able to be sufficiently maintained by using a coil skid including two steel plates each having a thickness of 1 mm and a glass wool heat insulating material having a total thickness of 100 mm stacked alternately. Thus, a coil skid having the same structure as the coil skid 10 illustrated in FIG. 1 was fabricated. That is, on the coil yard, a coil skid was fabricated in which as a metal plate, a 1-mm-thick stainless steel plate was laid on a portion in contact with an outer peripheral portion of the hot-rolled coil, and then as a heat insulating material, a 50-mm-thick glass wool was stacked on a lower layer of the stainless steel plate, a 1-mm-thick stainless steel plate was further stacked on a lower layer of the glass wool, and a 50-mm-thick glass wool was further stacked on a lower layer of the stainless steel plate.

The hot-rolled coils prepared as described above were cooled to ordinary temperature on the coil yard having this coil skid, and the cooled hot-rolled steel sheets were cold rolled to 1.19 mm to manufacture high-strength steel sheets.

Reference Example 1

A high-strength steel sheet was manufactured in the same manner as in Example 1, except that the thickness of the glass wool in each of the layers as the heat insulating material was changed from 50 mm to 40 mm.

Comparative Example 1

A high-strength steel sheet was manufactured in the same manner as in Example 1, except that a coil skid was fabricated in which as the metal plate, a 2-mm-thick stainless steel plate was laid on a portion in contact with the outer peripheral portion of the hot-rolled coil and as the heat insulating material, a 100-mm-thick glass wool was stacked on a lower layer of the stainless steel plate.

Comparative Example 2

A high-strength steel sheet was manufactured in the same manner as in Example 1, except that a coil skid was fabricated in which as the metal plate, a 1-mm-thick stainless steel plate was laid on a portion in contact with the outer peripheral portion of the hot-rolled coil and as the heat insulating material, a 80-mm-thick glass wool was stacked on a lower layer of the stainless steel plate.

Comparative Example 3

A high-strength steel sheet was manufactured in the same manner as in Example 1, except that a coil skid was fabricated in which as the metal plate, a 2-mm-thick stainless steel plate was laid on a portion in contact with the outer peripheral portion of the hot-rolled coil and as the heat insulating material, a 100-mm-thick glass wool was interposed between the outer peripheral portion of the aforementioned hot-rolled coil and the aforementioned metal plate.

(Evaluation Method)

The strength of the coil skid and the heat insulating effect were evaluated for the high-strength steel sheets in Examples 1 to 2 and Comparative examples 1 to 3 manufactured in the above manner.

(1) Evaluation of the Strength of the Coil Skid

To evaluate the strength of the coil skid, after cooling of the hot-rolled coil, the surface of the coil skid was observed and evaluated as follows.

○: The case where there was no effect on the metal plate portion

×: The case where deformation such as dent or fracture occurred in the metal plate portion (2) Evaluation of the Heat Insulating Effect To evaluate the heat insulating effect, the occurrence of the gauge hunting in cold rolling was evaluated as follows by using a hunting amount H of the cold-rolled steel sheet expressed by the following equation, as an index.

$$H=\{(\text{Amplitude of hunting [mm]})/(\text{Total thickness [mm]})\times 100[\%]$$

◎: H is less than 0.5%

○: H is 0.5% or more and less than 1%

× H is 1% or more (Evaluation Effects)

The results of the above evaluations are illustrated in Table 1. As illustrated in Table 1, Example 1 and Example 2, in which two layers of the metal plate and two layers of the heat insulating material were each stacked, exhibited good results in terms of both the strength of the coil skid and the heat insulating effect. In particular, Example 1, in which the total thickness of the heat insulating material was 100 mm, had a particularly good heat insulating effect.

In the meantime, Comparative example 1 and Comparative example 2 each using the coil skid in which one layer of the metal plate and one layer of the heat insulating material were only provided had a result inferior in the strength of the coil skid. In particular, Comparative example 2, in which the total thickness of the metal plate was only 1 mm and the total thickness of the heat insulating material was less than 100 mm, had a result inferior in both the strength and the heat insulating effect. Further, Comparative example 3, in which the heat insulating material was interposed between the hot-rolled coil and the metal plate instead of the heat insulating material being provided in the coil skid, had a result inferior in both the strength and the heat insulating effect because the heat insulating material was crushed. Further, in Comparative example 3, the heat insulating material was in contact with the hot-rolled coil, and adhesion of the heat insulating material was observed on the surface of the cooled hot-rolled coil.

TABLE 1

| | FIRST LAYER OF METAL PLATE (mm) | FIRST LAYER OF HEAT INSULATING MATERIAL (mm) | SECOND LAYER OF METAL PLATE (mm) | SECOND LAYER OF HEAT INSULATING MATERIAL (mm) | STRENGTH | HEAT INSULATING EFFECT |
|---|---|---|---|---|---|---|
| EXAMPLE 1 | 1 | 50 | 1 | 50 | ○ | ◎ |
| EXAMPLE 2 | 1 | 40 | 1 | 40 | ○ | ○ |
| COMPARATIVE EXAMPLE 1 | 2 | 100 | — | — | X | ◎ |
| COMPARATIVE EXAMPLE 1 | 1 | 80 | — | — | X | X |
| COMPARATIVE EXAMPLE 1 | 2 | * | — | — | ○ | X |

* IN COMPARATIVE EXAMPLE 3, HEAT INSULATING MATERIAL WAS INTERPOSED BETWEEN HOT-ROLLED COIL AND METAL PLATE. INCIDENTALLY, ADHESION OF HEAT INSULATING MATERIAL WAS OBSERVED ON SURFACE OF COOLED HOT-ROLLED COIL.

INDUSTRIAL APPLICABILITY

The present invention is useful for a coil skid and a steel sheet manufacturing method that cools a hot-rolled coil on this coil skid.

EXPLANATION OF CODES

1 hot-rolled coil
10 coil skid
11 metal plate
12 heat insulating material

What is claimed is:

1. A coil skid on which a hot-rolled coil obtained by coiling a hot-rolled steel sheet is placed, the coil skid comprising:

at least two or more layers of a metal plate and at least two or more layers of a heat insulating material each stacked alternately, wherein the thickness of each of the heat insulating materials is 70 mm or less, and the total thickness of the heat insulating material is 100 mm or more, wherein the metal plate is in contact with the hot-rolled coil.

2. A steel sheet manufacturing method including coiling a hot-rolled steel sheet into a coil, and then conveying the coiled hot-rolled coil to a coil yard by a coil car, and cooling the hot-rolled coil on either or both of the coil car and the coil yard, wherein on either or both of the coil car and the coil yard, the coil skid according to claim 1 is provided.

3. The steel sheet manufacturing method according to claim 2, wherein, a coiling temperature of the hot-rolled steel sheet is 400° C. to 750° C.

4. The steel sheet manufacturing method according to claim 2, wherein after cooling the hot-rolled coil, cold rolling is performed.

5. A steel sheet manufacturing method including coiling a hot-rolled steel sheet into a coil, and then conveying the coiled hot-rolled coil to a coil yard by a coil car, and cooling the hot-rolled coil on either or both of the coil car and the coil yard, wherein on either or both of the coil car and the coil yard, a coil box intended for housing the hot-rolled coil therein is provided, and in the coil box, the coil skid according to claim 1 is provided.

* * * * *